US005176062A

United States Patent [19]

Maillefer

[11] Patent Number: 5,176,062

[45] Date of Patent: Jan. 5, 1993

[54] BRAIDING MACHINE

[76] Inventor: Charles E. Maillefer, Au Village, 1164 Buchillon, Switzerland

[21] Appl. No.: 561,570

[22] Filed: Aug. 2, 1990

[30] Foreign Application Priority Data

Aug. 17, 1989 [CH] Switzerland ..... 3008/89

[51] Int. Cl.[5] ..... D04C 3/12

[52] U.S. Cl. ..... 87/51; 87/13; 87/62

[58] Field of Search ..... 87/20, 50, 33, 48, 51, 87/55, 57, 6, 9, 13, 62; 57/13, 15

[56] References Cited

U.S. PATENT DOCUMENTS

| | | | |
|---|---|---|---|
| 1,805,494 | 5/1931 | McCahey | 87/29 |
| 1,913,292 | 6/1933 | Schweiter | 87/50 |
| 2,931,162 | 4/1960 | Klein et al. | 57/13 |
| 3,053,288 | 9/1962 | Burbank | 57/13 X |

FOREIGN PATENT DOCUMENTS

| | | |
|---|---|---|
| 0321406 | 6/1989 | European Pat. Off. . |
| 636146 | 5/1983 | Switzerland . |
| 853454 | 11/1960 | United Kingdom . |
| 1299611 | 12/1972 | United Kingdom . |

*Primary Examiner*—Joseph J. Hail, III
*Attorney, Agent, or Firm*—Oliff & Berridge

[57] ABSTRACT

Two supports (8 and 9) mounted on parallel axes (10 and 11) respectively comprise two parallel arms (24 and 25) and portions (20 and 21) of a runway. A pay-out reel (26) for the core of the braid is mounted on a carriage (23) which rolls on the runway (20, 21), remaining at the bottom thereof. A mandrel (28) integral with the carriage guides the core-wire of the braid toward a braiding die-plate (3) at which the braid elements unwinding from reels (4–7) borne by the supports converge.

10 Claims, 7 Drawing Sheets

BRAIDING MACHINE

BACKGROUND OF THE INVENTION

This invention relates to a winding apparatus, and more particularly to a braiding machine of the type having a frame, a pay-out reel for a braid core, means for holding the braid-core pay-out reel, two rotary supports rotating about axes determined relative to the frame, and reel-holders for braid elements mounted on each of the supports and each bearing a pay-out reel for a braid element unwinding from the reel, the whole disposed in such a way that the braid elements coming from the reels mounted on each support and the supports together delimit two closed volumes which interpenetrate one another and comprise a common portion, the holding means holding the braid-core pay-out reel in a certain position within that common portion.

In braiding machines of conventional design, one of the two conical nappes described by the braid elements coming from each of the two groups of reel-holders has as a directrix a circle centered on the braiding axis, whereas the other nappe—owing to the periodic actuation of a set of radially moving levers—has as a directrix a closed curve which is likewise centered on the braiding axis, but which has a lobate shape. These machines are complicated and noisy. Furthermore, the speed of the reel-holders on their supports along their orbits is limited.

It has already been sought to remedy these drawbacks, and to this end, U.K. Patent No. 1,299,611 describes a braider arrangement in which the reel-holders provided for the braid elements describe different closed curves, generally circles, being guided on runways which intersect and are equipped with propulsion means. This arrangement avoids the lobate curve shape and the effects of inertia resulting therefrom; but the driving of carriages along runways creates design complications which preclude the stability desirable in designs of this type.

According to one prior art proposal (U.K. Patent No. 853,454), the reel-holders for the braid elements are divided between two rotary supports disposed so that the surfaces described by the braid elements coming from the reels mounted on each support, together with the respective support, bound two interpenetrating closed volumes. A reel for paying out the core of the braid is accommodated in the space thus defined, which is common to both volumes.

While this arrangement is topologically favorable, this prior art patent does not suggest any mechanically reliable solution for holding the reel for paying out the core of the braid. The support of this reel is held in place by the joint action of the two supports on which the reel-holders for the braid elements are mounted, so that it is subject to the effects of friction and of inertia. Moreover, construction is greatly complicated if there are more than two reels for braid elements.

OBJECTS AND SUMMARY OF THE INVENTION

It is an object of this invention to provide an improved braiding machine which differs mechanically from that described in U.K. Patent No. 853,454 while preserving the same topological arrangement of the various elements facing each other.

To this end, in the braiding machine according to the present invention, of the type initially mentioned, the holding means comprises a remote-acting operating means.

BRIEF DESCRIPTION OF THE DRAWINGS

Preferred embodiments of the invention will now be described in detail with reference to the accompanying drawings, in which.

DETAILED DESCRIPTION OF PREFERRED EMBODIMENTS

Figure 1:
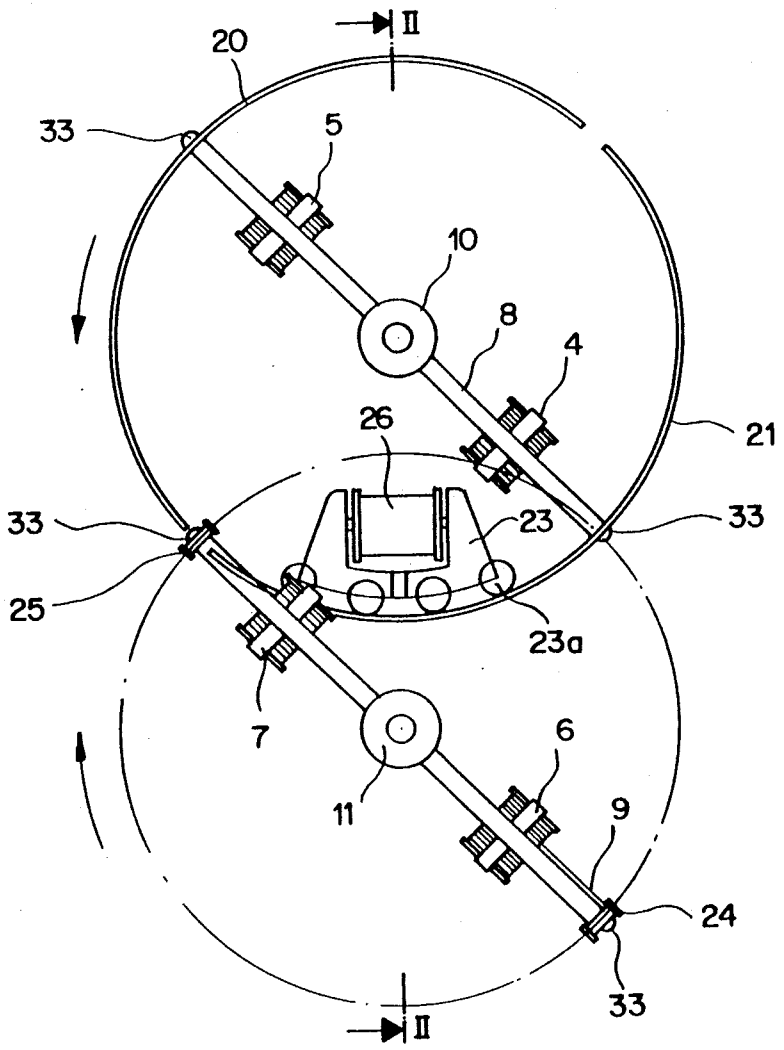
FIGS. 1 and 2 are diagrammatic sectional views of a first embodiment, taken on the planes I—I and II—II, respectively.
Figure 2:
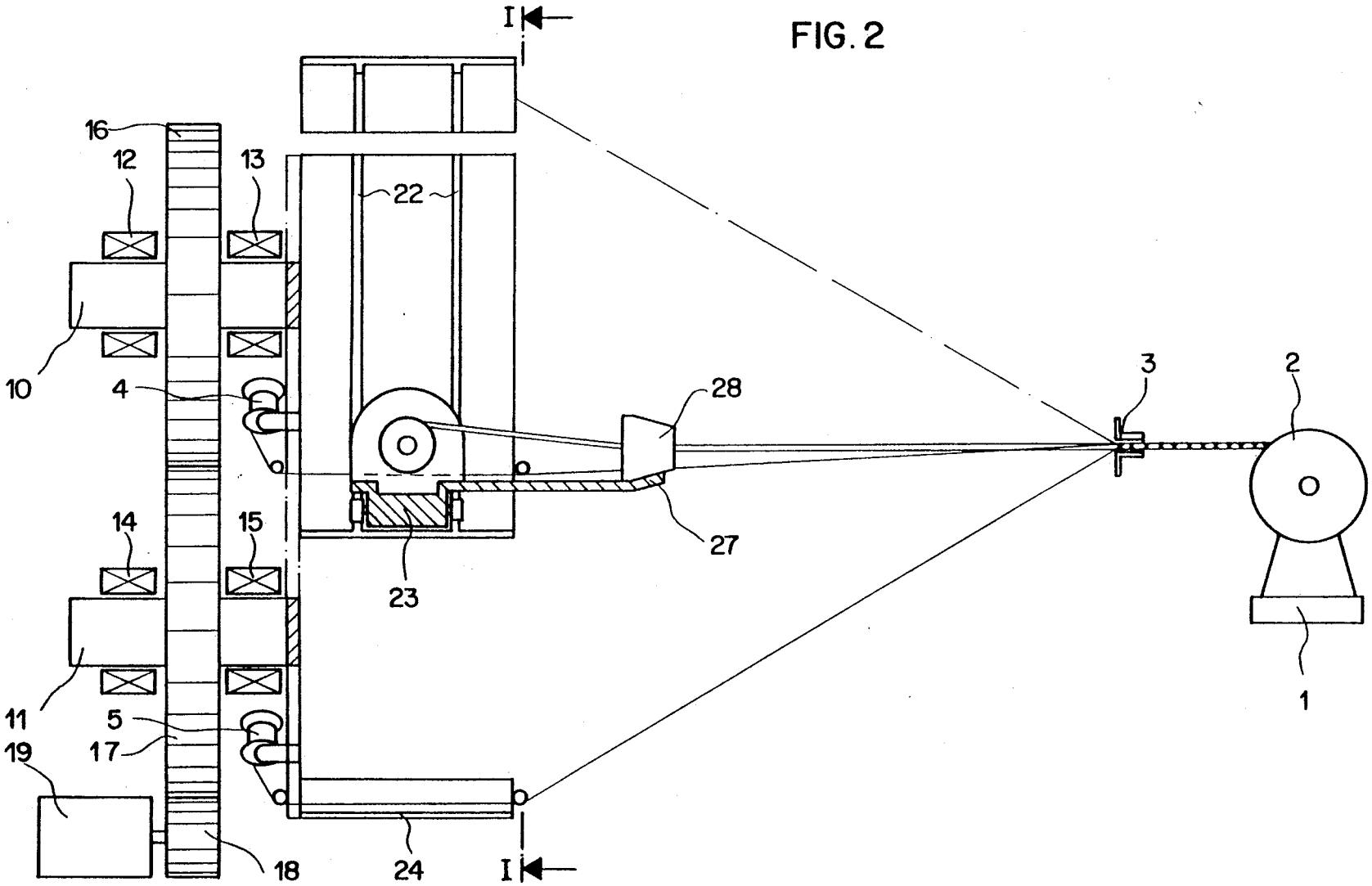

In FIGS. 1 and 2, a braiding machine frame comprises a support 1 of a braid take-up reel 2 situated downstream from a braiding die-plate 3 placed at the point of braiding. The general layout of the machine is horizontal. Reels bearing four braid elements are divided in pairs with their reel-holders 4, 5, 6, and 7 between two supports 8 and 9 (FIG. 1), the main parts of which are straight bars fixed at their centers to shaft elements 10 and 11 rotating in fixed bearings 12, 13, 14, and 15. Shaft elements 10 and 11 are disposed horizontally and symmetrically relative to the braiding axis, i.e., relative to a horizontal line coaxial with braiding die-plate 3. Pinions 16, 17, and 18 transmit a rotational motion to shafts 10 and 11 from a motor 19, in such a way that shafts 10 and 11 rotate in opposition directions as indicated by the arrows in FIG. 1.

Fixed to respective ends of arm 8 are rigid semi-enclosures 20 and 21 which together form a cylindrical runway having a horizontal axis, interrupted only at two diametrically opposed passages where narrow slits remain. Each of the runways 20, 21 has on its inside surface two rails 22 so that a carriage 23, mounted on pairs of rollers **23*a*, is continuously held by the force of gravity in the lowest parts of roller paths 20 and 21 when support 8 is driven along with shaft 10**.

Fixed on the central generatrix of each of the semi-enclosures 20 and 21 are guide eyelets 33 for the braid elements unwinding from reel-holders 4 and 5.

Besides the diametrical bar already mentioned, the length of which is the same as that of bar 8, support 9 comprises two strips 24 and 25 which are likewise provided with eyelets 33 for guiding the braid elements unwinding from reels 6 and 7. Strips 24 and 25 and their respective eyelets 33 are so arranged that when supports 8 and 9 rotate in opposite directions, strips 24 and 25 pass alternately through the slits formed between runway parts 20 and 21. Hence they enter within the volume bounded by these runways. Thus carriage 23, which runs by its own weight on rails 22 when support 8 rotates, is constantly held in a stable position within the space which is common to the two volumes bounded by supports 8 and 9, and the conical surfaces defined by the braid elements which leave the braid reels pass through eyelets 33 and arrive at braiding point 3.

A braid-core pay-out reel 26 mounted on support 23 unwinds regularly while reel 2 is driven rotatingly.

As seen in FIG. 2, carriage 23 may be equipped with an arm 27 supporting a guide eyelet 28 for the core of the braid.

It will be understood that instead of each support 8 or 9 being equipped with two reel-holders 6 and 7 or 4 and 5, provision might equally well be made for supports having three or more radial arms regularly distributed about shafts 10 and 11 and each bearing at its outer end either a runway element such as elements 20 and 21, or an axially positioned strip such as strips 24 and 25.

Figure 3:
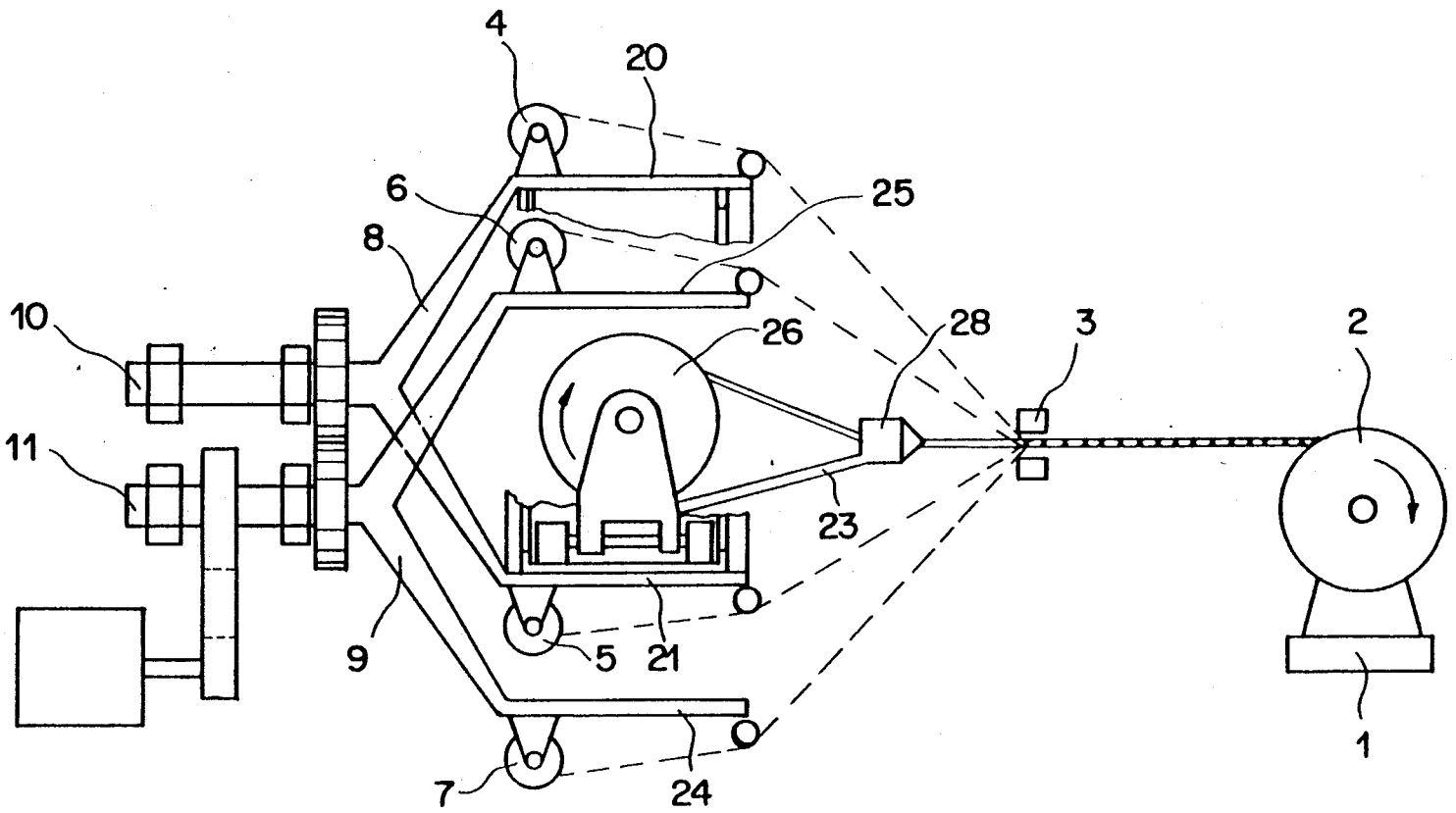
FIG. 3 is a general sectional view similar to FIG. 2 of a modification of the first embodiment.

The arrangement shown in FIG. 3 is very similar to that just described. It will be noted, however, that here the radial arms 8 and 9 which replace the arms of the first modification are positioned obliquely relative to shafts 10 and 11 in the plane containing the axis of the shaft. This arrangement permits the axes of shafts 10 and 11 to be closer together and consequently provides more room for the space common to the two volumes defined by the supports and the envelopes described by the braid elements coming from the reels mounted on each support. In this modification, axial strips 24 and 25, like runway elements 20 and 21, bear on their outer faces reel-holders 4, 5, 6, and 7 for the braid elements.

Figure 4:
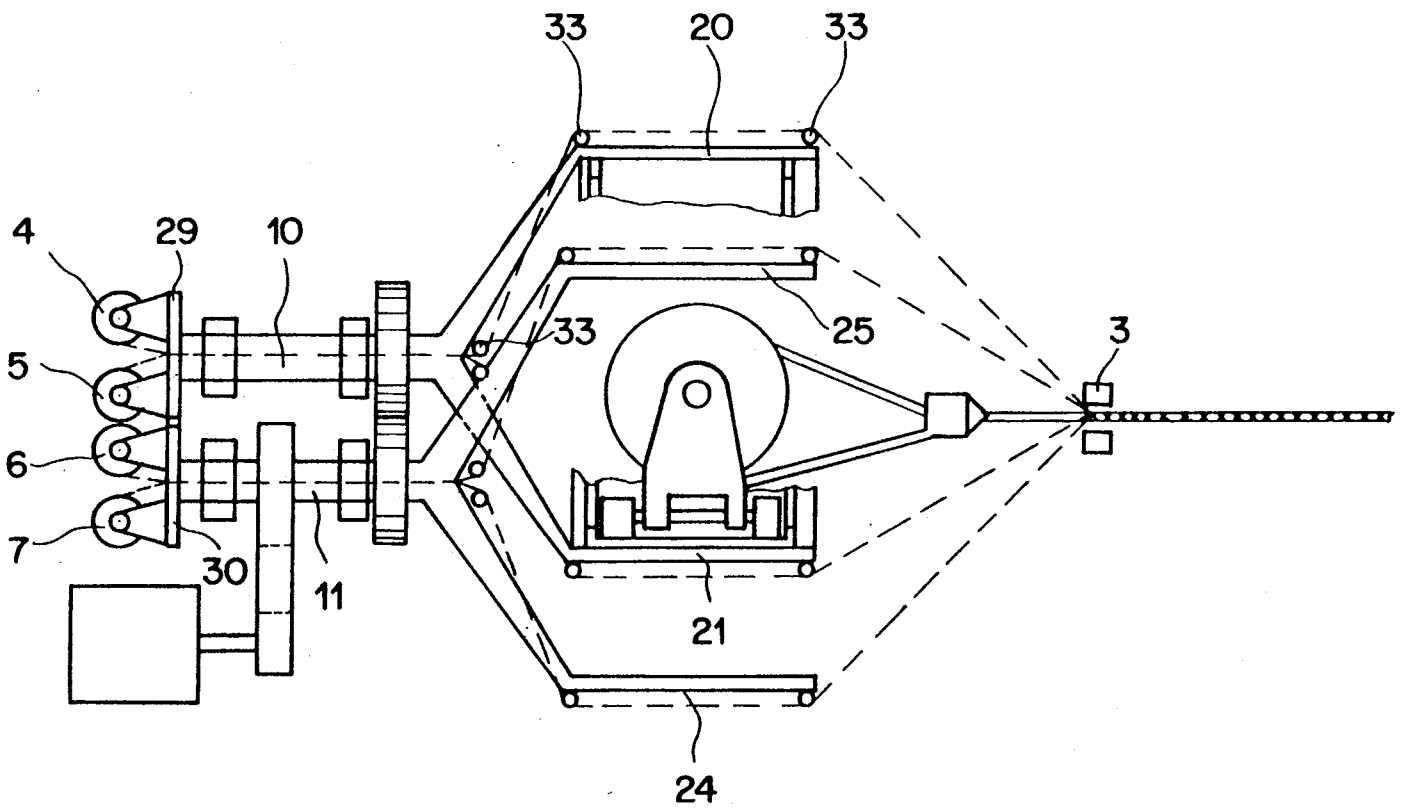
FIG. 4 is a view of the same type as FIG. 3, showing another modification.

FIG. 4 illustrates another modification based upon the same design, wherein the two supports have substantially the same shape as in the modification of FIG. 3. In this modification, however, shafts 10 and 11 are hollow shafts. Here the reel-holders 4, 5, 6, and 7 for the braid elements are grouped on circular plates 29 and 30 which are respectively fixed to the rearward ends of shafts 10 and 11 so that the braid elements unwinding from the reels pass in the center of the shafts and are then guided by the rollers to arrive at the outer edges of strips 24 and 25 or of runway portions 20 or 21 facing braiding die-plate 3.

Figure 5:
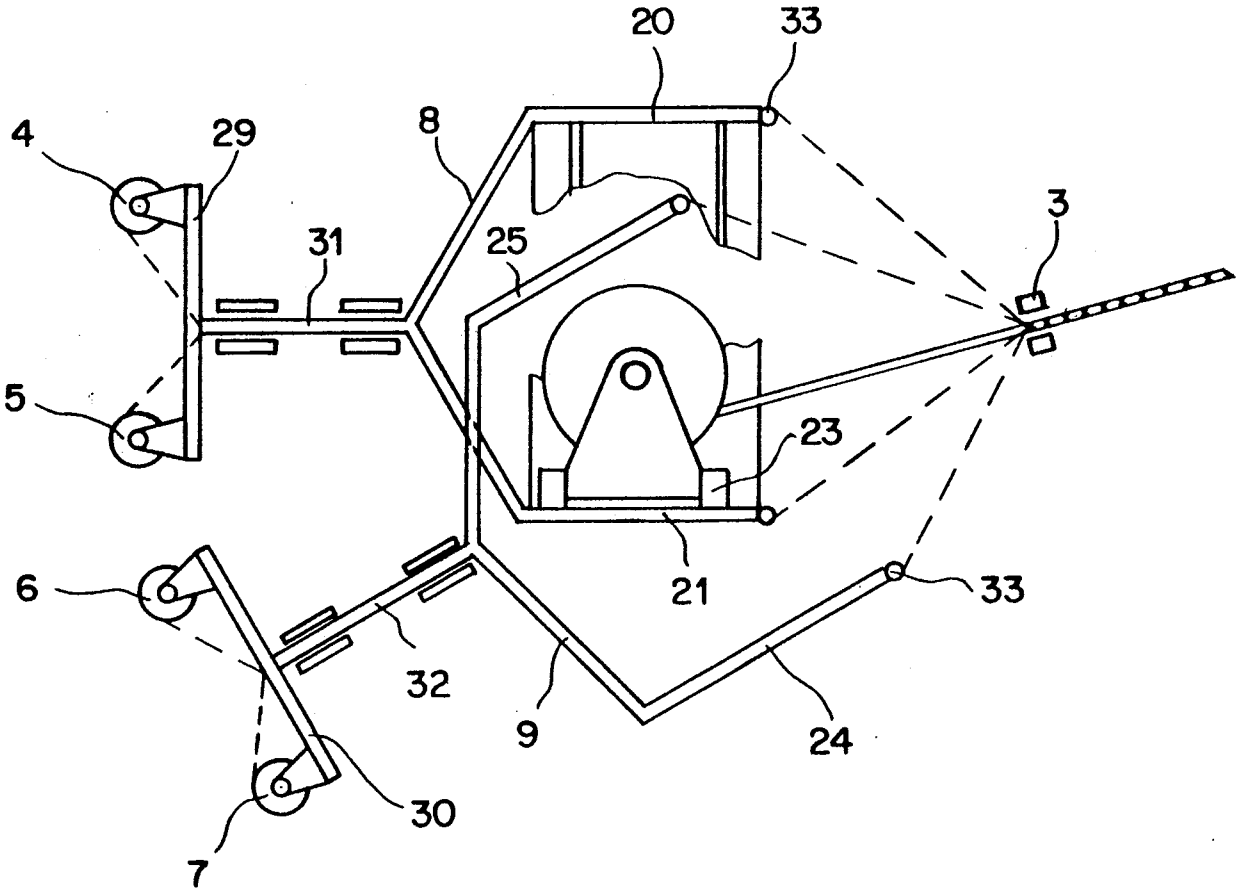
FIG. 5 is a diagrammatic view of a second embodiment of the inventive braiding machine.

FIG. 5 shows diagrammatically an arrangement in which the two supports 8 and 9 are mounted on shafts 31 and 32 which are not parallel, but the axes of which form an angle and intersect at the braiding point defined by braiding die-plate 3.

In this case, too, shafts 31 and 32 are hollow shafts, and the reel-holders of braid elements 4, 5, 6, and 7 are mounted on disks 29 and 30 integral with shafts 31 and 32, respectively. It will be noted that shaft 31 is disposed horizontally, so that partial runways 20 and 21 are situated in a vertical plane, and carriage 23 is held by the force of gravity at the lowest point of this runway. Hence shaft 32 is placed obliquely, its axis being directed upward and situated in a vertical plane containing the axis of shaft 31.

Figure 6:
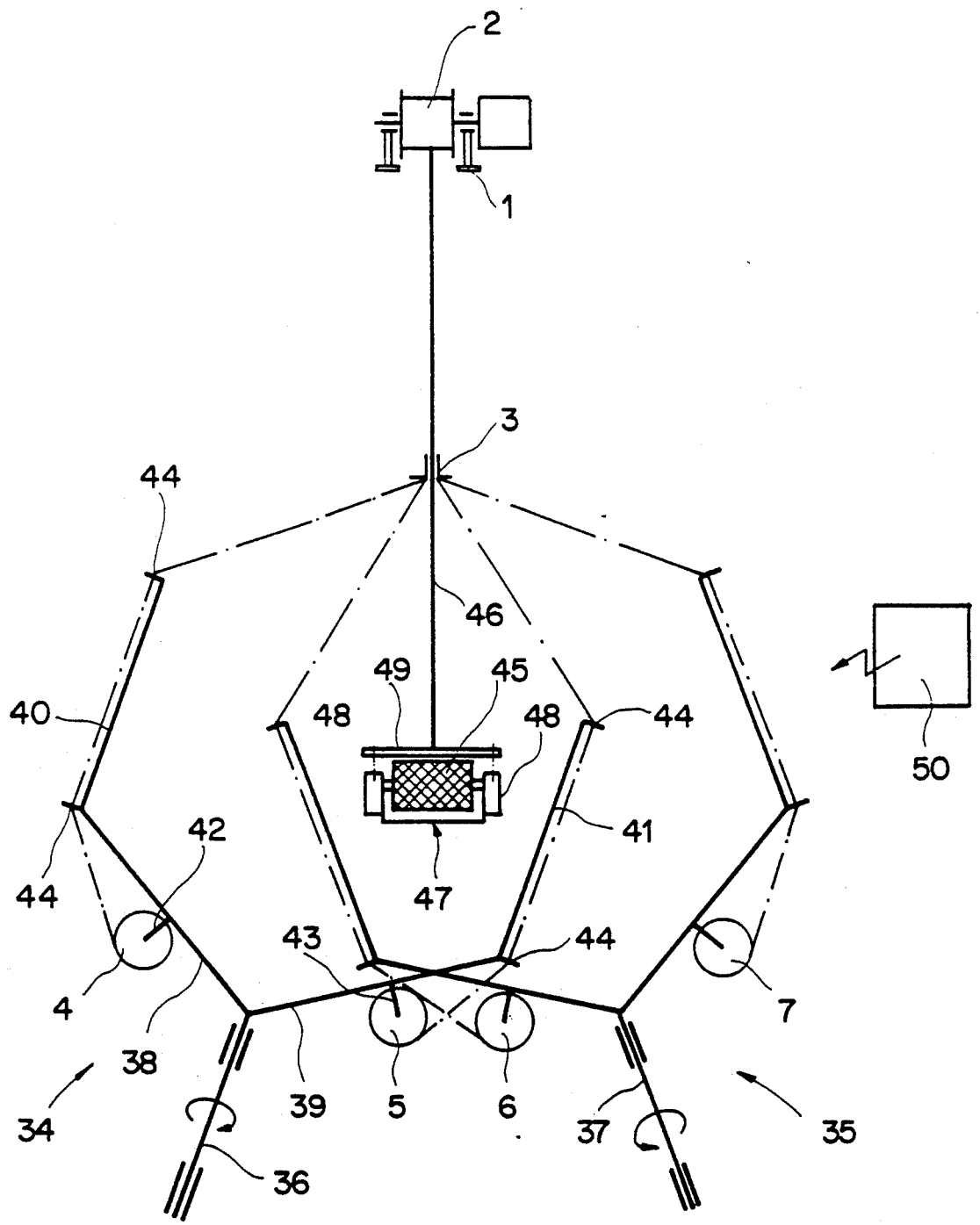
FIG. 6 is a diagrammatic view of a third embodiment.

In a third embodiment, now to be described and shown diagrammatically in FIG. 6, the requirements concerning the arrangement of the reel supports relative to the vertical are different.

Appearing again in FIG. 6 are braid take-up reel 2 with its drive means and its support 1, as well as braiding die-plate 3. Instead of being horizontal, the arrangement is now vertical.

The machine comprises two supports 34 and 35 for the reel-holders of the braid elements. These two supports 34 and 35 are of similar design here and are disposed symmetrically in a vertical plane. Their shafts 36 and 37, analogous to shafts 31 and 32, are directed toward the braiding point. Each support 34 or 35 comprises two diametrically opposite arms 38 and 39 extending obliquely toward braiding die-plate 3 and continued by two guide rods 40 and 41. Two reel-holders 42 and 43 are mounted on the outer sides of arms 38 and 39. The braid elements unwind from reels 4, 5, 6, and 7 in such a way as to pass through eyelets 44 and to end at braiding point 3, thus defining two volumes which are closed by arms 38 and 39 and which interpenetrate.

Since supports 34 and 35 are of identical design, they will simply be positioned relative to their drive means in such a way as never to be situated in the same plane.

In this embodiment, a reel 45 which pays out the core wire 46 of the braid is mounted on a reel-holder 47, the sides of which bear electromagnetically operated gripping devices 48 acting upon a bar 49 which extends along reel 45. This bar may be provided with a roller. It acts as a brake, device 48 being electronically remote-controlled from a control and regulating unit 50, and reel-holder 47 being equipped with a sensor which detects the vertical level or the unwinding speed of reel 45. Thus, elements 47, 48, and 50 permit the braking force exerted by bar 49 to be regulated so that reel 45, suspended from core 46 of the braid, is kept at a constant height or unwinds at a rate synchronized with the winding speed of take-up reel 2. Hence assembly 47 remains in a stabilized position within the space common to the two volumes bounded by the braid elements and their supports. This maintenance of position takes place through the action of the electronic remote control regulated by device 50.

Figure 7:
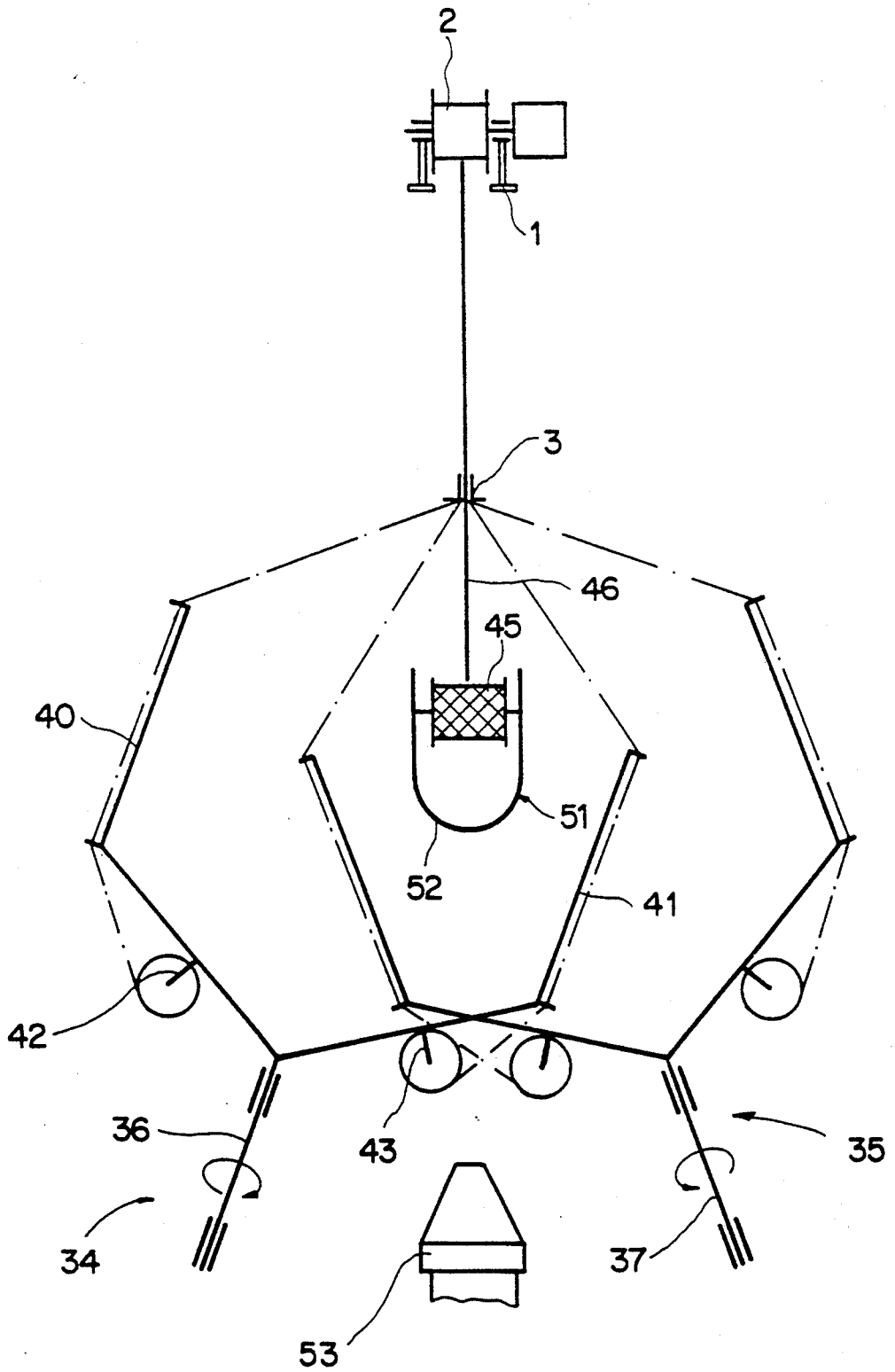
FIG. 7 is a diagrammatic view of a fourth embodiment.

Finally, a fourth embodiment of the invention will be described as shown in FIG. 7, also diagrammatically.

In this drawing figure, there is again found an arrangement comprising two reel supports 34 and 35 and a support 1 for braid take-up reel 2, which is exactly like what is shown in FIG. 6. Thus there is again found on each of the two supports 34 and 35 reel-holders 42, 43 and arms 40 or 41 parallel to respective shafts 36 or 37.

It will be understood that in this embodiment, like that of FIG. 6, there might be more than two arms 38, 39 on each support. It will be noted that here it is easier to increase the number of arms and, consequently, of reel-holders for the braid elements than in the embodiments where the support of the wire-core pay-out reel is designed as a carriage rolling on a runway.

In the embodiment now being described, wire core 46, paid out from reel 45, extends vertically downstream from braiding die-plate 3 and slightly at a slant upstream from that die-plate, as in the arrangement of FIG. 6. Reel 45 pivots on a support 51 which comprises simply a bearing and a cowling 52. This cowling cooperates with a fluid-propulsion device shown here in the form of a pipe 53 but which might, as the case may be, take the form of a vertical-axis ring having several jets.

Jets may also be fixed to the semi-enclosures such as elements 20 and 21 of FIG. 1, which represents a horizontal-axis embodiment in which carriage 23 is replaced by a support floating on an air cushion.

Propulsion device 53 or the described jets are preferably fed with compressed air and create a bearing cushion for reel support 51.

It will be noted that an electromagnetic support device might equally well be provided in lieu of the air cushion support device shown here.

Thus, through the use of a remote-acting operating means utilizing the force of gravity or some other force field, the pay-out reel for the braid-core wire is held in position within the completely closed space defined by the interpenetration of the two volumes defined by the supports of the braid elements and the surfaces described by the braid elements themselves when they end at the braiding point. Stabilization of the position of this reel is obtained by reliable, practical means which are easy to produce.

What is claimed is:

1. A braiding machine comprising:

a braid-core pay-out reel for paying out a braid core to a braiding point;

at least one braid element pay-out reel for paying out at least one braid element to said braiding point;

two spaced rotatable supports, each rotatable support being rotatable about a rotation axis, said at least one braid element pay-out reel being mounted on one of said rotatable supports, said rotatable supports being rotatable in an overlapping manner to define an intersecting common volume; and a carriage to which said braid-core pay-out reel is secured, said carriage being freely movable along a surface on one of said rotatable supports, said carriage being maintained substantially stationary at a predetermined location within said intersecting common volume by gravity, wherein said surface has rails and said carriage is mounted on rollers, said rollers being movable along said rails of said surface, said carriage being oriented substantially horizontally along said surface when said braid-core pay-out reel pays out said braid core.

2. The braiding machine according to claim 1, wherein each of said rotatable supports comprises at least one substantially straight bar, each of said straight bars having a center fixed to a shaft element being rotatable in a fixed bearing, one of said shaft elements being rotatable in one direction and another of said shaft elements being rotatable in a direction opposing said one direction.

3. The braiding machine according to claim 2, wherein:

each of said straight bars has two ends;

each of said straight bar ends of at least one of said straight bars is fixed to an arcuate member;

said arcuate members are located adjacent to one another to form a substantially cylindrical member;

said arcuate members each having two ends, the ends of one of said arcuate members being spaced from the ends of the other of said arcuate members; and said surface is provided on an interior of said arcuate members.

4. The braiding machine according to claim 3, wherein:

each of said two ends of at least one other straight bar has a strip; and each said strip includes a guide means for guiding one braid element from said at least one braid element pay-out reel to said braiding point, rotation of said rotatable supports causing one of said strips to pass through the spacing between one pair of adjacent arcuate member ends and at least one other of said strips to pass through the spacing between another pair of adjacent arcuate member ends.

5. The braiding machine according to claim 1, wherein each of said rotatable supports comprises:

a rotatable shaft element having two ends;

at least two radial arms extending from one end of said rotatable shaft element, each of said radial arms having two ends, one of said radial arm ends being fixed to said rotating shaft element; and axial strips extending from the other of said radial arm ends, said axial strips being substantially parallel to said rotatable shaft element, wherein one of said rotatable shaft elements is rotatable in one direction and another of said rotatable shaft elements is rotatable in a direction opposing said one direction.

6. The braiding machine according to claim 5, wherein said radial arms extend in oblique directions with respect to said rotatable shaft elements.

7. The braiding machine according to claim 5, wherein said at least one braid element pay-out reel is provided on at least one of said rotatable supports such that said at least one braid element extends from at least one of said strips to said braiding point.

8. The braiding machine according to claim 5, wherein:

said rotatable shaft elements are hollow;

a plate is attached to the other end of at least one of said rotatable shaft elements; and said at least one braid element pay-out reel is provided on said plate, such that a braid element paid out by said at least one braid element pay-out reel is extendable through one of said hollow shaft elements to said braiding point.

9. The braiding machine according to claim 8, wherein said rotatable shaft elements extend substantially parallel with respect to one another.

10. The braiding machine according to claim 8, wherein said rotatable shaft elements extend at an acute angle with respect to one another.

* * * * *